US007846035B2

(12) United States Patent
Bailey

(10) Patent No.: US 7,846,035 B2
(45) Date of Patent: Dec. 7, 2010

(54) GOLF SWING EXERCISING/TRAINING APPARATUS AND ASSOCIATED METHOD

(76) Inventor: William Bailey, 308 Streett Cir., Forest Hill, MD (US) 21050

( * ) Notice: Subject to any disclaimer, the term of this patent is extended or adjusted under 35 U.S.C. 154(b) by 161 days.

(21) Appl. No.: 12/291,716

(22) Filed: Nov. 14, 2008

(65) Prior Publication Data

US 2010/0124998 A1 May 20, 2010

(51) Int. Cl.
*A63B 69/36* (2006.01)

(52) U.S. Cl. ..... 473/259; 473/229

(58) Field of Classification Search ..... 473/226, 473/229, 257, 258, 259, 260, 266, 269, 274, 473/275, 276

See application file for complete search history.

(56) References Cited

U.S. PATENT DOCUMENTS 1,633,527 A * 6/1927 Hansen ..... 473/229
2,520,287 A * 8/1950 Plunkett et al. ..... 473/259
2,690,911 A * 10/1954 Newgren ..... 473/271
3,711,103 A * 1/1973 Seltzer ..... 473/229
3,730,531 A * 5/1973 Zega ..... 473/259
3,795,399 A * 3/1974 Beckish ..... 473/229
3,926,430 A 12/1975 Good, Jr.
5,439,225 A 8/1995 Gvoich et al.
5,441,275 A 8/1995 Yoshishita
5,816,932 A 10/1998 Alexander
5,895,327 A * 4/1999 Francisco ..... 473/229
6,402,633 B1 6/2002 Hsiung et al.
7,074,133 B1 7/2006 Jones et al.
7,144,340 B1 12/2006 Jones et al.

* cited by examiner

*Primary Examiner*—Nini Legesse

(57) ABSTRACT

A golf swing exercising and training apparatus for assisting a user to improve a golf swing may include a curvilinear track sized and shaped to simulate a golf swing. A frame may be situated on a ground surface to keep the track at a stable position. The track may be angularly offset such that a beginning point is situated anterior to a finishing point of the track. A mechanism may be included for teaching users to maintain a desired spine angle, and the desired head and arm positions during operation. The teaching mechanism may include a moveable guide member slidably coupled to the track, a mechanism for maintaining direct and continuous contact between the guide and track, and a mechanism for prohibiting the user's head from rising beyond a predetermined height during operation. In addition, a mechanism for indicating proper arm movement during an initial backswing may be included.

16 Claims, 11 Drawing Sheets

GOLF SWING EXERCISING/TRAINING APPARATUS AND ASSOCIATED METHOD

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to sport training equipment and, more particularly, to a golf swing exercising and training apparatus for assisting a user to improve a golf swing.

2. Prior Art

Among businessmen and professionals, golf has long been the sport of choice. Today, with the rise of stars such as Tiger Woods and Phil Mickelson, and the lasting popularity of legends such as Jack Nicklaus and Arnold Palmer, the sport is more popular than ever. Every year from spring to fall throughout the United States and the world, thousands of players head out to municipal courses and private clubs to tee up and take aim down the fairway. With their bags strapped to their backs or loaded on carts, golfers make their way through the course, counting their strokes and trying to stay under par. Ask any avid golfer and they will tell you, the greatest part of the game is the fresh cut grass and warmth of the summer day, the feel of the ball hitting the sweet spot of the club, and watching it soar off into the sky only to bounce down onto the distant green. Business associates, doctors and lawyers, fathers and sons, sisters and mothers, high school kids and college teams alike bring out their clubs every season in hopes of beating their personal best scores.

However, golf is not always fun, and rarely is it easy. Courses are designed to challenge the player and make low scores difficult to achieve. It is not unusual to see frustration on the faces of disgruntled players on the eighteenth hole, after a day of searching for their ball in the heavy rough, or watching them hook off into the trees or ponds, lost forever. While money may buy the most popular or custom made clubs and gear, or may pay for hours of lessons, one of the most important aspects of the game is perfecting the swing. Without a consistent motion and approach at every tee, players will likely find themselves pitching from off the fairway, behind trees, or digging out of a sand trap. It is for this reason that machines have been invented to assist a player in coordinating his or her arms, hips, and legs to uncover and maintain the perfect swing.

U.S. Pat. No. 6,656,055 to Marro discloses a machine for learning the bodily position and motion known as a swing in the game of golf to form correct golf posture based on a player's height, and more specifically the player's distance from the hips to the ground and from the shoulders to the hips and by the motions during the golf swing. The machine learns the bodily position and motions of the golf player in hitting the ball. The machine includes two plates arranged so that they can move on a column, one at the height of the player's hips and the other at the height of the shoulders, the latter with arms leaving said plate and ending in a hinged belt for holding the hips and the other having a lower arm and upper arm terminating in a shoulder bar for holding the player's shoulders. Unfortunately, this prior art reference does not disclose a means for correctly training a user how to position their head during the swinging procedure, a vital component of a desired golf swing.

U.S. Pat. No. 4,040,633 to Sciarrillo discloses a golf practice device having a golf club guiding member consisting of a single tube wound in the form of a helix having in excess of one and a half turns. The diameter of the helix is somewhat less than the arc of a club head during the golf swing and the guide is supported on the ground or other surface such that the helix lies approximately in the plane defined by the shaft of a golf club during the normal golf swing. One end of the helix terminates adjacent the impact region of the club with the golf ball. The helical guide member extends away from the point of impact in the direction of the back swing. The pitch of the helix increases so that the overlapping turns of the helix are divergent in going from the point of impact to the top of the back swing region of the golf swing. The overlapping turns of the helix are held in fixed spaced relation by a supporting leg in the form of an open loop, the ends of the loop supporting the adjacent overlapping portions of the helical guide. One end of the helix may be braced from the supporting leg. Unfortunately, this prior art reference does not disclose a means of positioning the user's spine, head, and arms in such a manner to teach correct posture during swinging procedures.

U.S. Pat. No. 5,139,264 to Wootten discloses a golf swing training apparatus including a base, an upright support frame, rotary guide arm assembly at the top of the support frame establishing a reference axis of rotation at an inner arm portion and having an outer end flexibly coupled to the club head so that as the club is swung it is confined to a swing plane perpendicular to the reference axis of rotation. There is adjustment in frame height and angle of incline for the reference axis of rotation as well as adjustment in the drag. There is also a tensioning feature to dampen the inertia mass during the stroke. Unfortunately, this prior art reference also does not assist the user in training their muscles to memorize the desired movement of the swing and does not position the user's body in the correct stance to maximize swing accuracy.

Accordingly, a need remains for a golf swing exercising and training apparatus in order to overcome the above-noted shortcomings. The present invention satisfies such a need by providing a device that is convenient and easy to use, is durable yet lightweight in design, is versatile in its applications, and provides golfers with much needed assistance in improving their golf swing.

BRIEF SUMMARY OF THE INVENTION

In view of the foregoing background, it is therefore an object of the present invention to provide an apparatus for assisting a user to improve a golf swing. These and other objects, features, and advantages of the invention are provided by a golf swing exercising and training apparatus.

A golf swing exercising and training apparatus for assisting a user to improve a golf swing may include a curvilinear track suitably sized and shaped to simulate a golf swing. In addition, a frame may be attached to the track and may be situated on a ground surface in order that the track may remain at a substantially stable inclined position representative of an ideal swing plane during swinging procedures. The frame may be properly sized to allow the user to stand within the frame and adequately reach the track while operating the apparatus. The track further may be angularly offset from a vertical plane such that a beginning point of the track may be situated anterior to a finishing point of the track. In this manner, the track may overlap itself as it completes a full revolution teaching the user to complete the backswing facing the target after fully pivoting on their right foot with arms folded in toward their left shoulder and hands slightly behind the head.

Additionally, the apparatus may include a mechanism for teaching the user to maintain their spine at a desired angle while further maintaining their head and arms registered at respective desired positions during execution of the golf swing. This is vital due to the fact that correct posture and body movement is essential in perfecting a golf swing.

The teaching mechanism may further include a moveable guide member slidably coupled to the track and may be freely displaced along a bi-directional path while executing the golf swing. The guide member directs the movement of the user's body as the user's hands and arms follow it along the circular track. In addition, the teaching mechanism may include a mechanism for maintaining direct and continuous contact between the guide member and the track as the guide member is displaced along the bi-directional path. This operates such that the guide member may be prohibited from oscillating away from the track. At all times the guide member may stay attached to the track and may fluidly glide therealong to smooth the motion of the user's body during the swing.

The direct and continuous contact maintaining mechanism may include at least a first roller attached to a top side of the guide member and at least a second roller attached to a bottom side of the guide member. Additionally, the contact maintaining mechanism may include at least a third roller attached to a left side of the guide member and at least a fourth roller attached a right side of the guide member. Each of the first, second, third and fourth rollers may maintain direct rotational contact with the track and thereby cause the guide member to remain contiguously conjoined to the track during displacement along an entire longitudinal length of the track. The number of rollers preferably being the only frictional contact with the track allows the guide member to traverse the track with little physical effort by the user. This is advantageous in that it allows the user to perfect the movement of their swing without excessive frictional resistance being imparted by the contact maintaining mechanism.

The user teaching mechanism may further include a mechanism for prohibiting the user's head from rising beyond a predetermined height during the swinging procedures. This head prohibiting mechanism may include an arm statically anchored to the frame and extended forward from the track, and a stop member directly attached to an anterior tip of the arm. The stop member may be situated adjacent to a peak of the bi-directional path and may maintain continuous contact with the top of the user's head during the swinging procedures. This provides the unpredictable and unexpected benefit of training the user to maintain the correct position of their head during the swing. As a very common problem for most golfers occurs when the head is pulled back before the end of the swing, the head positioning mechanism is vital and advantageous in situating the position of the user's head and entire body during the swing.

In addition, the user teaching mechanism further may include a mechanism for indicating proper right arm movement of the user during an initial backswing along the bi-directional path. This proper right arm movement indicating mechanism may include a curvilinear rod preferably having opposing ends fixedly anchored to the frame and configured in such a manner to interest a rearwardly rising motion during swinging procedures. This may thereby prevent the user from dropping the right elbow during the swing procedures. This mechanism further teaches the appropriate movement of the user's body along the back swing as the user's back upper arm is encouraged to assume a position parallel to the ground, with the forearm at a right angle to the upper arm, upon completion of the backswing, as opposed to dropping the back elbow toward the body and incorrectly adjusting the down swing.

The guide member included with the golf swing exercising and training apparatus may include a body, a first bracket rotatably connected to a top face of the body, and a second bracket pivotally attached directly to the first bracket. Also, the guide member may include a rectilinear shaft statically anchored to the second bracket. This may operate in such a manner that the second bracket may be freely articulated about a fulcrum pivot axis defined at a connection point of the first and second brackets respectively. The rectilinear shaft operates to mimic the feel of a golf club as the user grips the shaft and uses it to direct the guide member through the movements of the swing. The pivoting of the shaft about the brackets allows the user's wrists to naturally turn as the guide slides along the track at different angles in relation to the user's body.

The present invention may further include a method for teaching a user to improve a golf swing. Such a method may include the chronological steps of first providing a curvilinear track suitably sized and shaped to simulate a golf swing. Second, the method may include providing and attaching a frame to the track by situating the frame on a ground surface in such a manner that the track may remain at a substantially stable inclined position representative of an ideal swing plate during swinging procedures. Finally, a third step may include teaching the user to maintain the user's spine at a desired angle while further maintaining the user's head and arms registered at respective desired positions during execution of the golf swing. The method assists the user to achieve a flawless swing by repeatedly performing the preferred motions and teaching the user's muscles to replicate the motions when actually swinging a golf club on the course.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
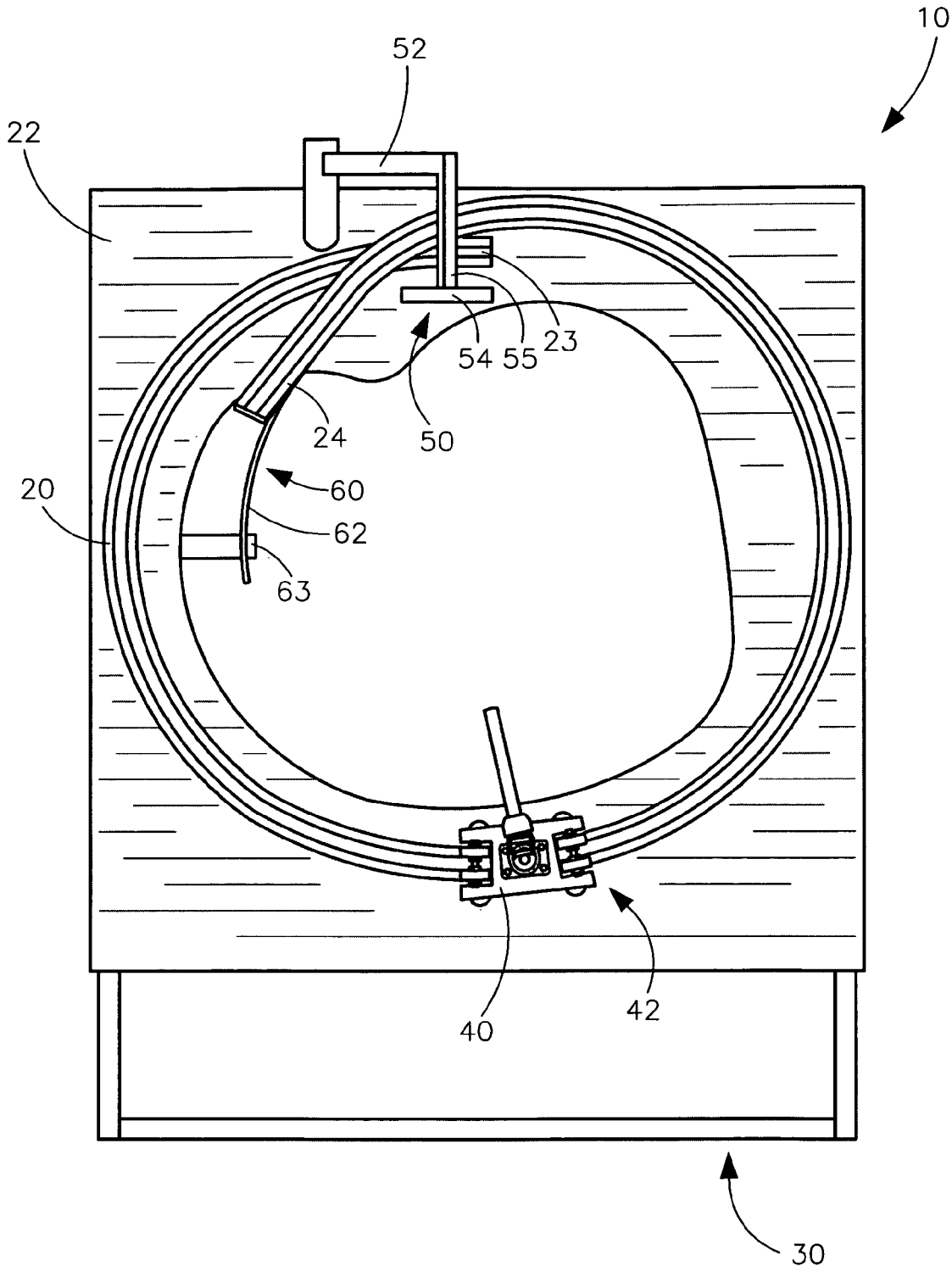
FIG. 1 is a front elevational view showing a golf swing exercising and training apparatus, in accordance with the present invention.
Figure 2:
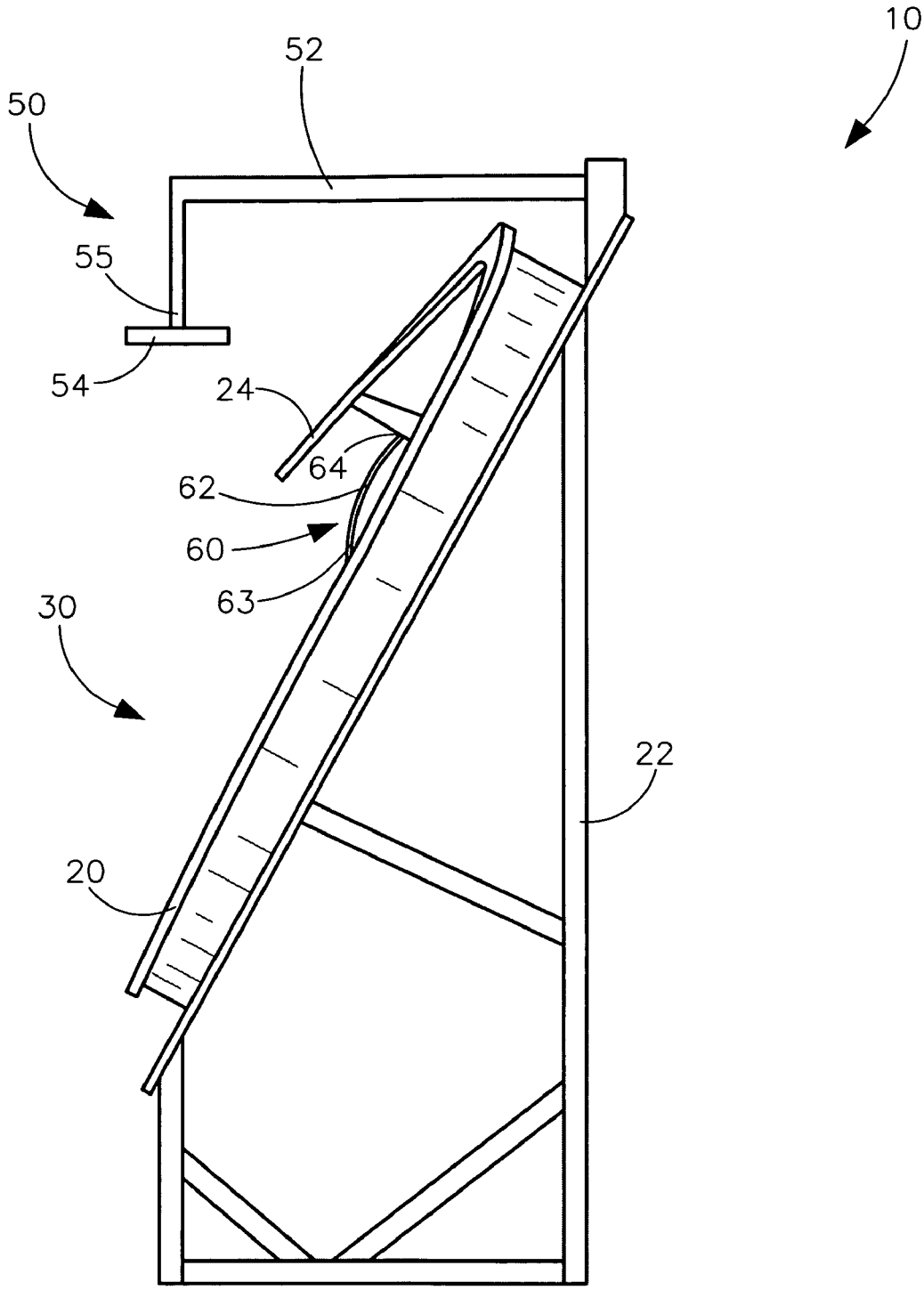
FIG. 2 is a left side elevational view showing the apparatus of FIG. 1.
Figure 3:
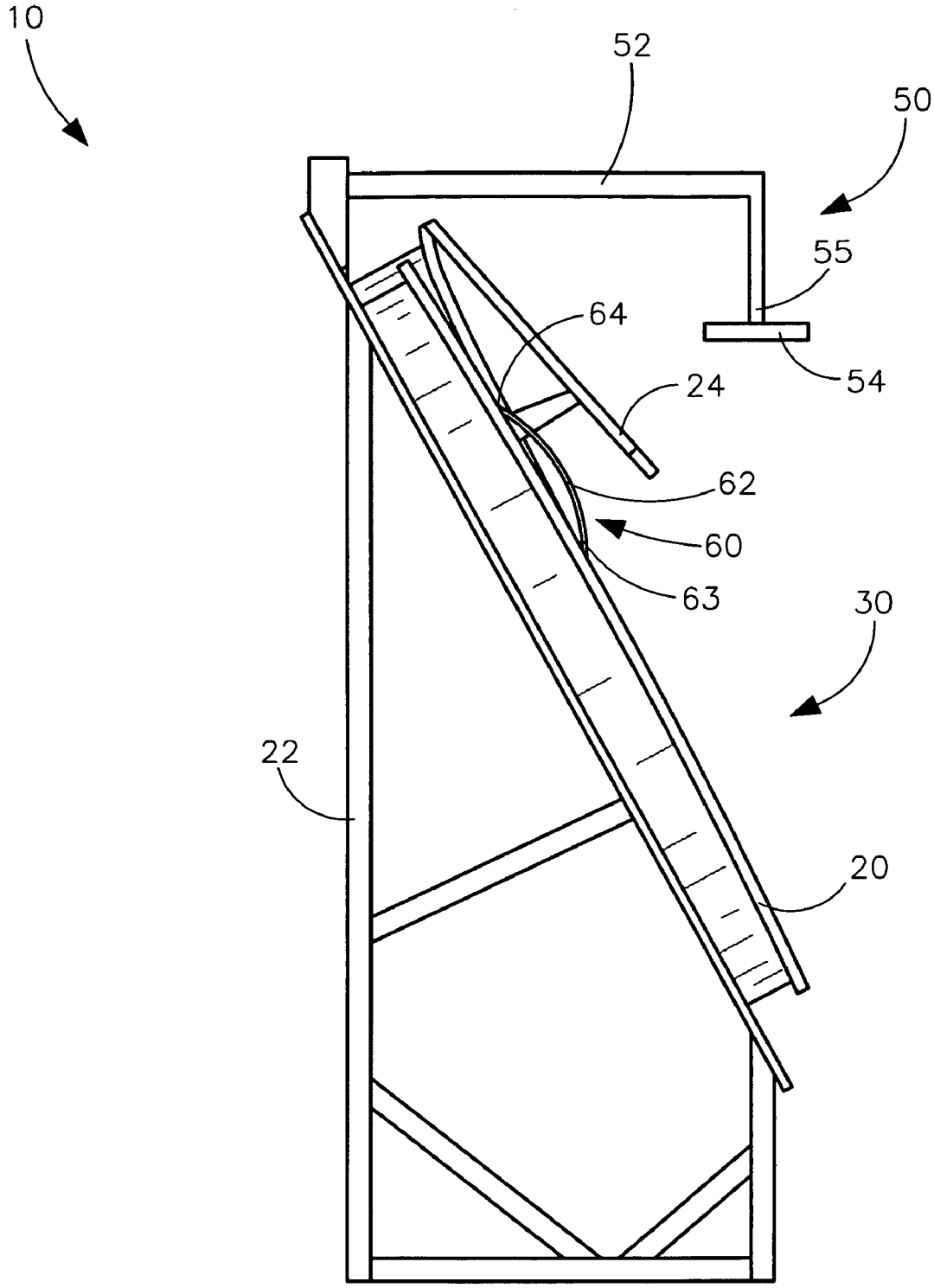
FIG. 3 is a right side elevational view showing the apparatus of FIG. 1.
Figure 4:
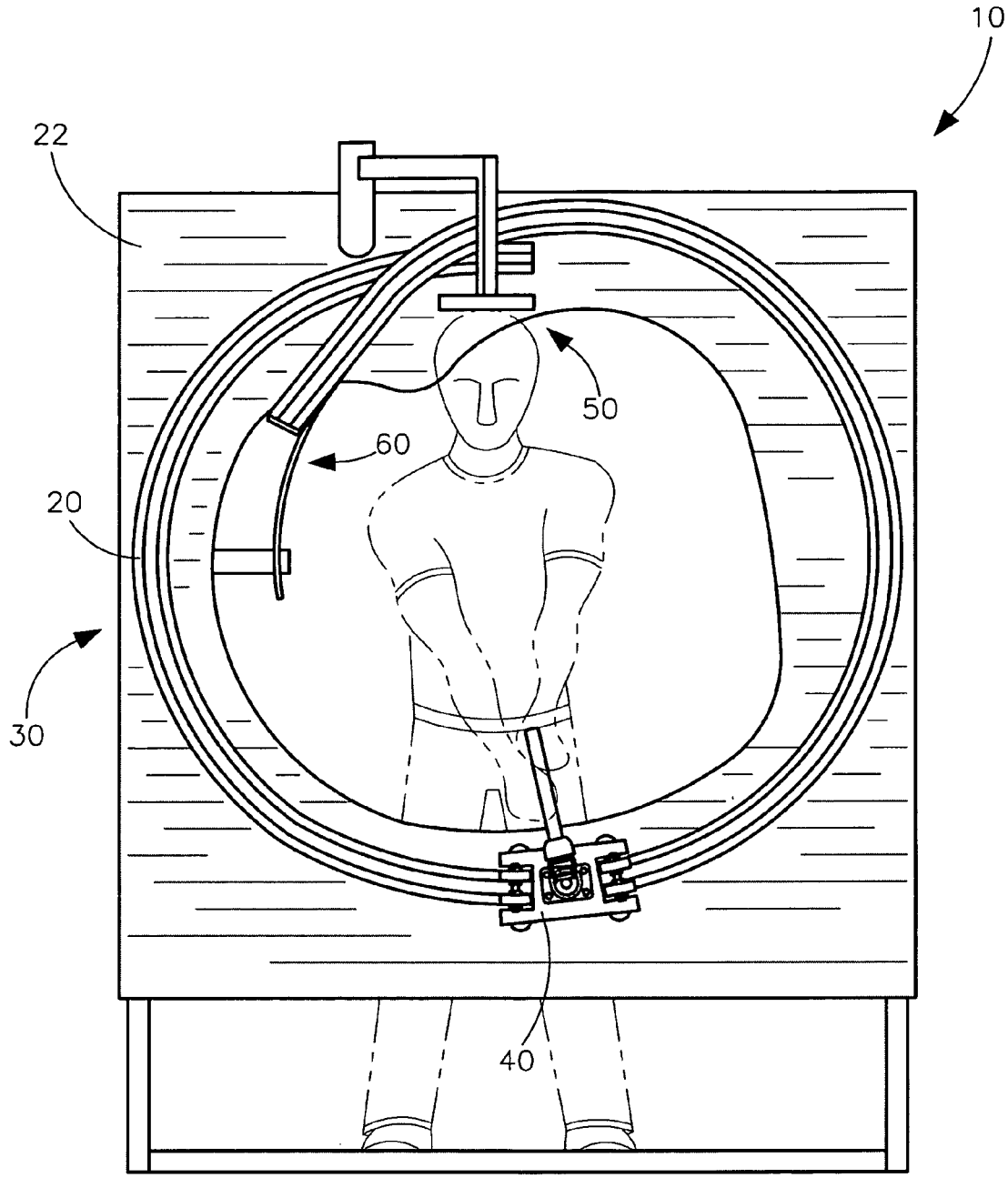
FIG. 4 is a front elevational view showing the apparatus of FIG. 1 with the guide member situated at the starting position.
Figure 5:
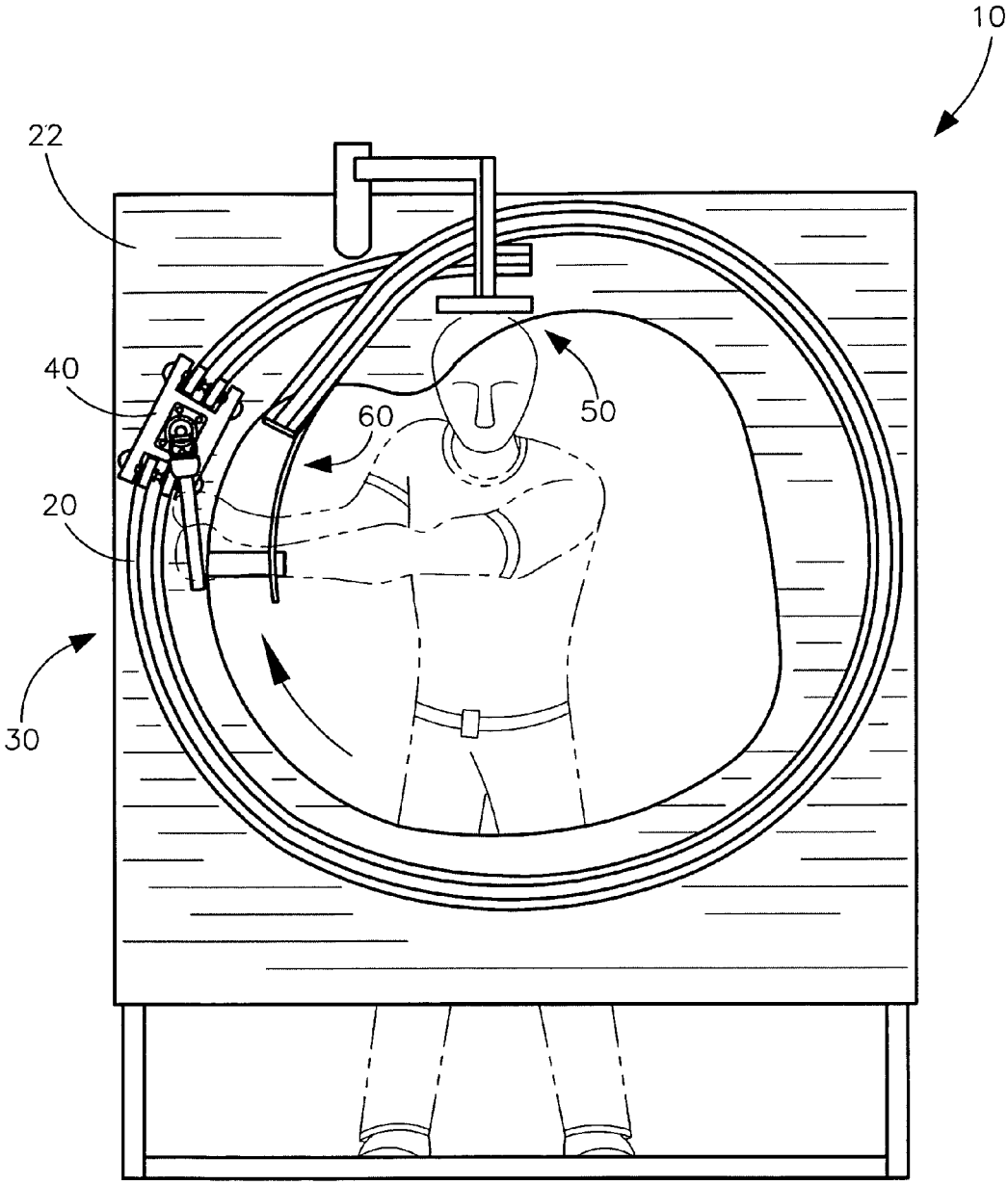
FIG. 5 is a front elevational view showing the apparatus of FIG. 1 with the guide member traveling along the track in a reverse direction as the user begins the back swing with the users left arm somewhat straight, right arm relaxed, and hands cocked at 90 degrees.
Figure 6:
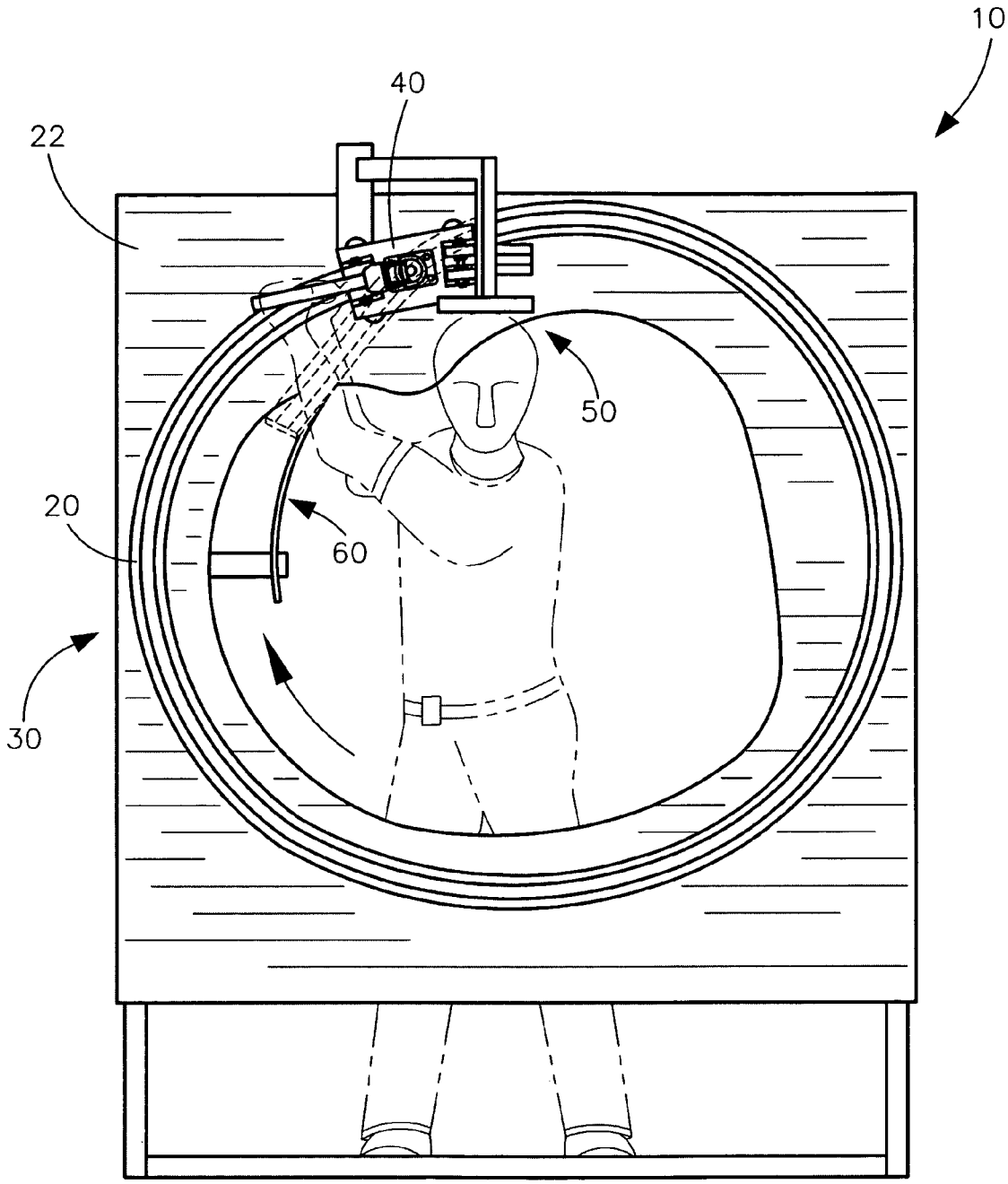
FIG. 6 is a front elevational view showing the apparatus of FIG. 1 with the guide member situated at the beginning point of the track that defines the desired end of the user's back swing with left arm partially straightened and right upper arm parallel to the ground.
Figure 7:
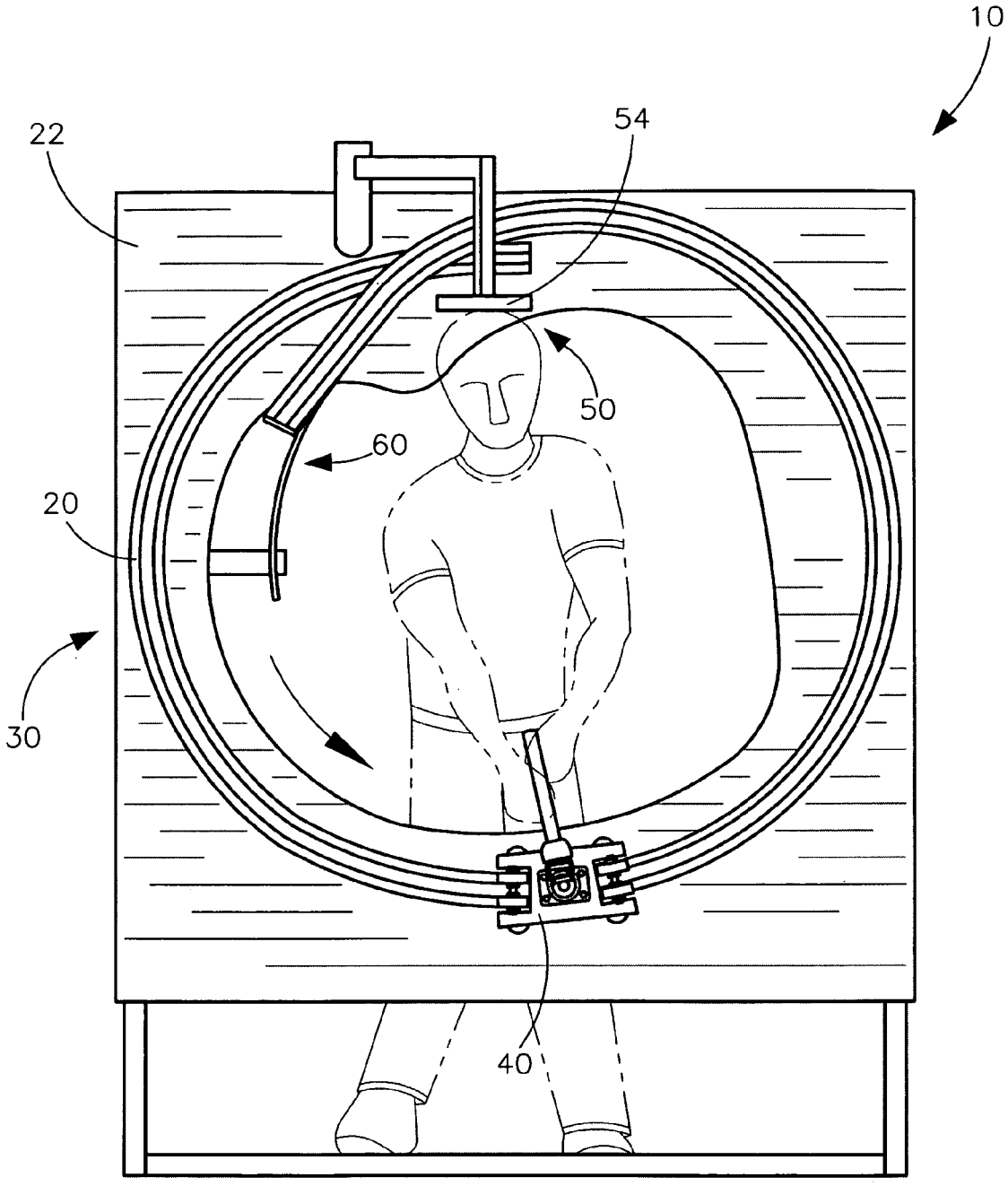
FIG. 7 is a front elevational view showing the apparatus of FIG. 1 with the guide member at the lowermost position of the track as the guide member travels along the track during the user's swing.
Figure 8:
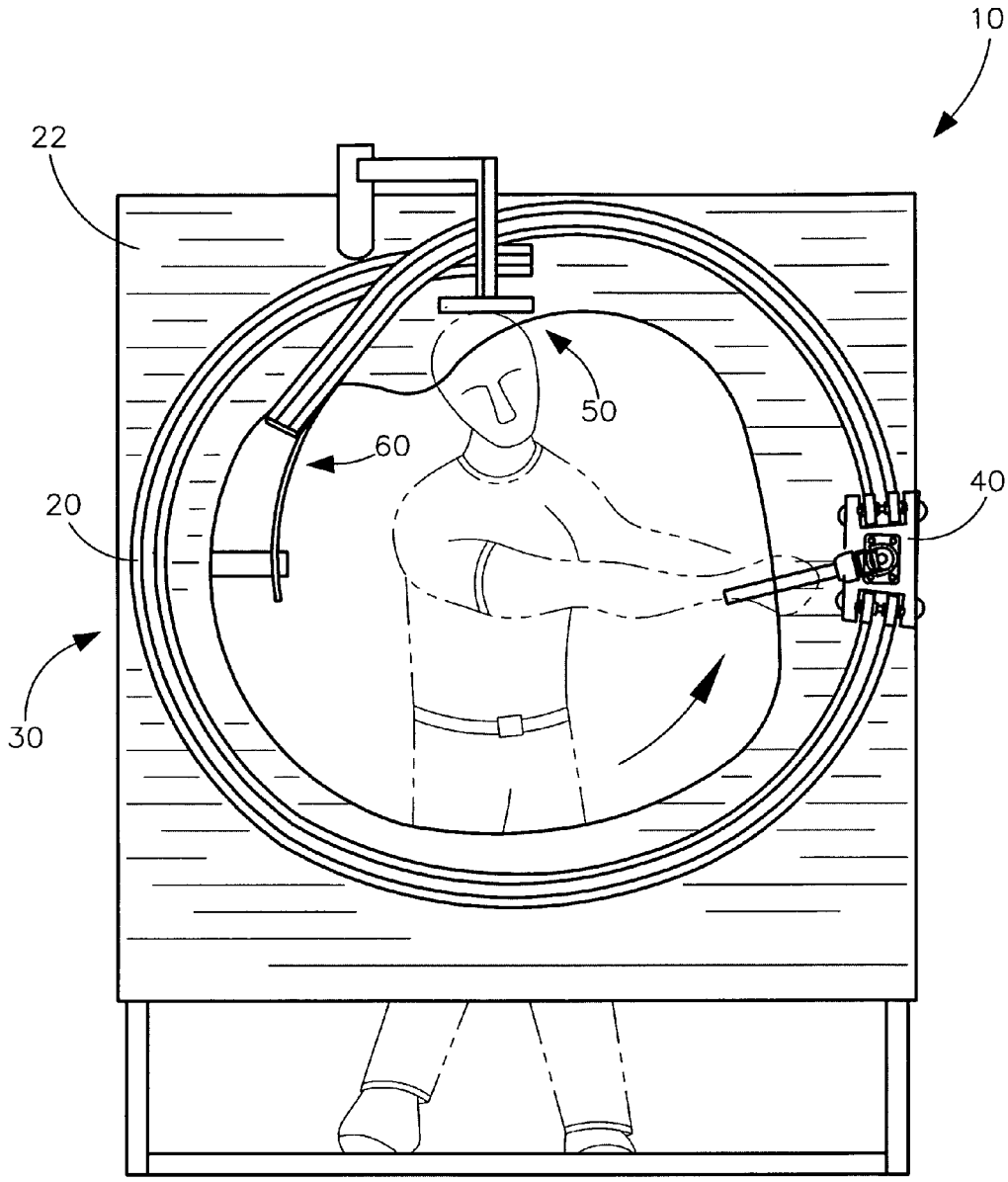
FIG. 8 is a front elevational view showing the apparatus of FIG. 1 with the guide member at the farthest forward position as the guide member travels along the track during the user's swing and the user's arms become fully extended and substantially parallel to the ground surface.
Figure 9:
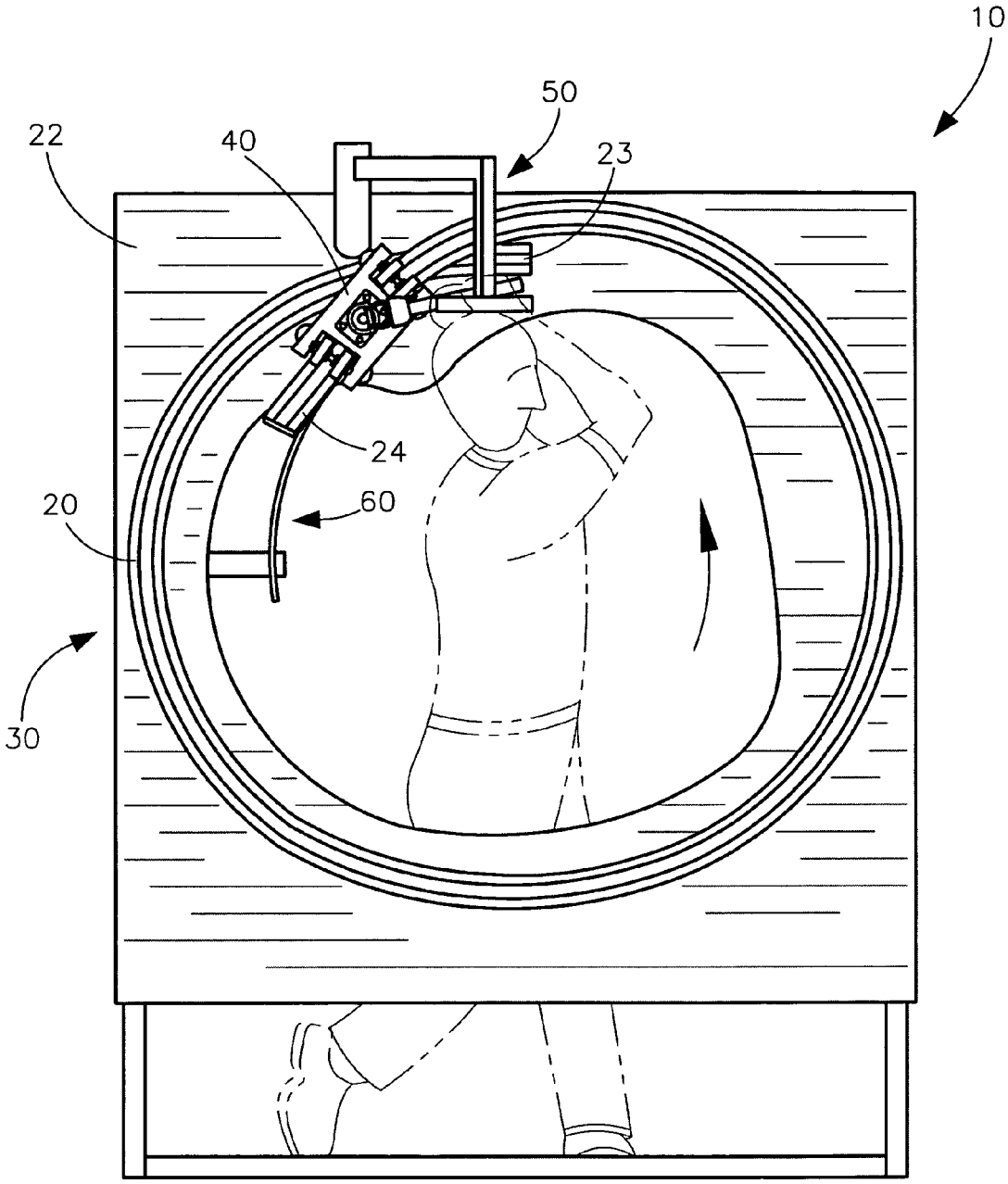
FIG. 9 is a front elevational view showing the apparatus of FIG. 1 with the guide member at the finishing point of the track during the end of the user's full backswing with the user facing the target after fully pivoting on right foot, arms folded in toward left shoulder, and rectilinear shaft pointed down and behind the user's back.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-11 by the reference numeral 10 and is intended to provide a golf swing exercising and training apparatus. It should be understood that the golf swing exercising and training apparatus 10 may be used to build strength and to teach users of many different ages and skill levels proper swing technique and should not be limited to the uses described herein.

Initially referring to FIGS. 1-9 in general, a golf swing exercising and training apparatus 10 for assisting a user to improve a golf swing may include a curvilinear track 20 suitably sized and shaped to simulate a golf swing. In addition, a frame 22 may be attached to the track 20 and may be situated on a ground surface in order that the track 20 may remain at a substantially stable inclined position representative of an ideal swing plane during swinging procedures. The frame 22 may be properly sized to allow the user to stand within the frame 22 and adequately reach the track 20 while operating the apparatus 10. The track 20 further may be angularly offset from a vertical plane such that a beginning point 23 of the track 20 may be situated anterior to a finishing point 24 of the track 20. In this manner, the track 20 may overlap itself as it completes a full revolution allowing the user to complete a full backswing facing the target after fully pivoting on their right foot with arms folded in toward the left shoulder and hands slightly behind the head.

Additionally, the apparatus 10 may include a mechanism 30 for teaching the user to maintain their spine at a desired angle while further maintaining their head and arms registered at respective desired positions during execution of the golf swing. The present invention 10, as claimed, provides the unexpected and unpredictable benefit of teaching the user correct posture and body movement, essential elements in perfecting a golf swing.

Referring to FIGS. 1, and 4-11, the teaching mechanism 30 may further include a moveable guide member 40 slidably coupled to the track 20 and may be freely displaced along a bi-directional path while executing the golf swing. The guide member 40 directs the movement of the user's body as the user's hands and arms follow it along the circular track 20. Additionally, the teaching mechanism 30 may include a mechanism 42 for maintaining direct and continuous contact between the guide member 40 and the track 20 as the guide member 40 is displaced along the bi-directional path. This operates such that the guide member 40 may be prohibited from oscillating away from the track 20. At all times the guide member 40 may stay attached to the track 20 and may fluidly glide therealong to smooth the motion of the user's body during the swing.

Figure 10:
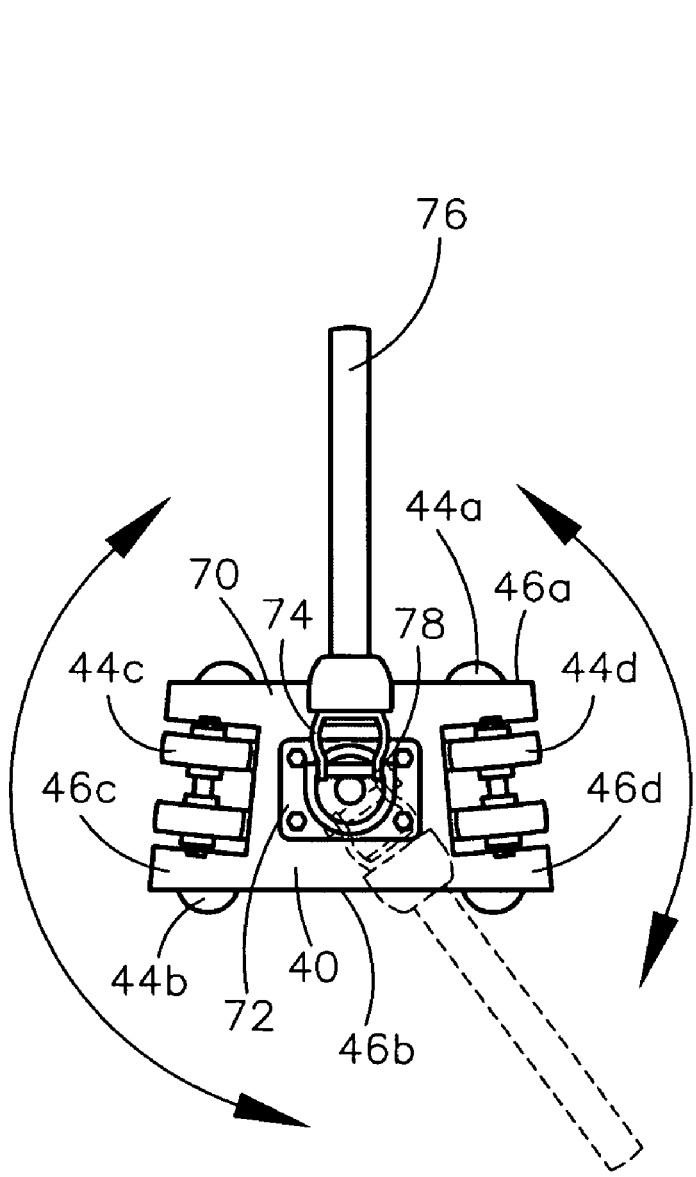
FIG. 10 is a top plan view of the guide member showing the rectilinear shaft rotating about the first bracket on the top of the body.
Figure 11:
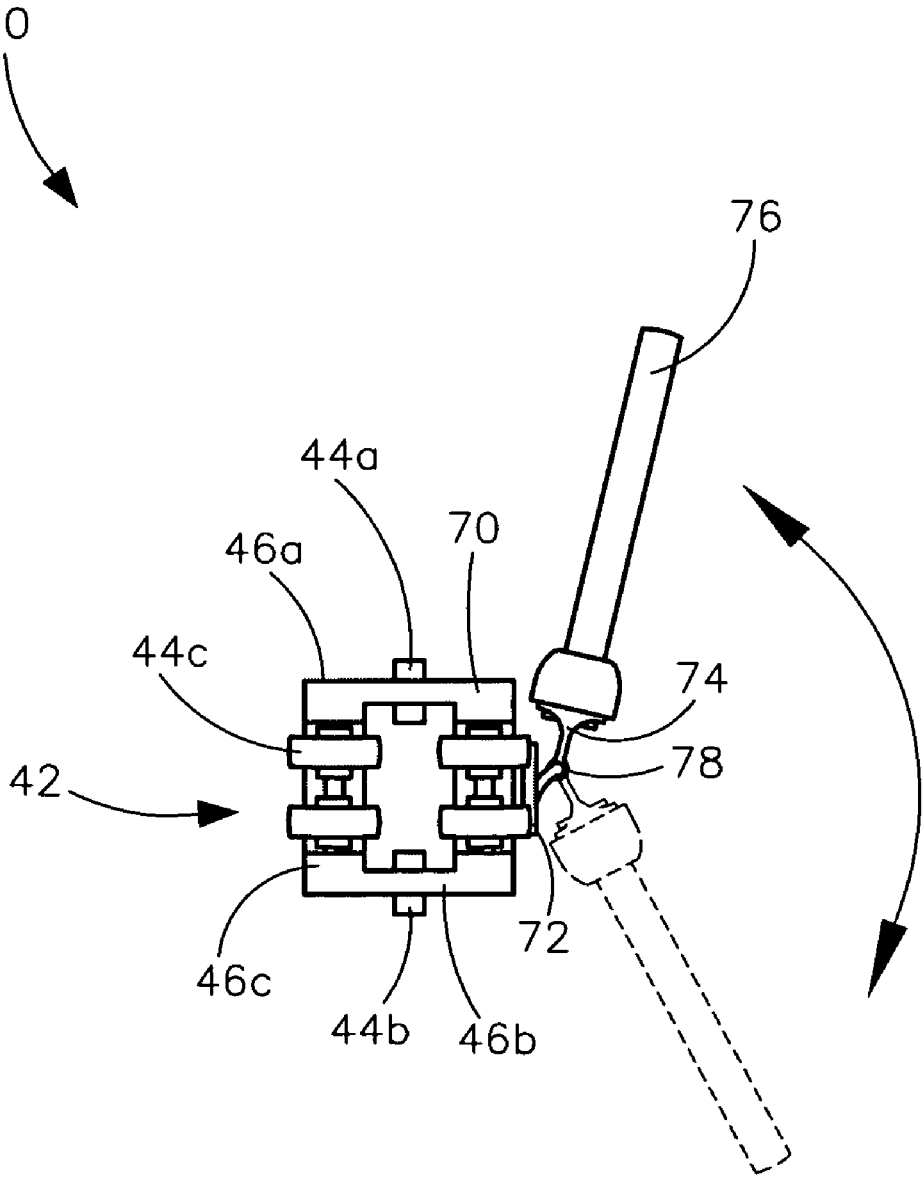
FIG. 11 is a left side elevational view of the guide member in FIG. 10 showing the rectilinear shaft pivoting about the fulcrum axis defined by the first and second brackets.

Referring specifically to FIGS. 10 and 11, the direct and continuous contact maintaining mechanism 42 may include at least a first roller 44A attached to a top side 46A of the guide member 40 and at least a second roller 44B attached to a bottom side 46B of the guide member 40. Additionally, the contact maintaining mechanism 42 may include at least a third roller 44C attached to a left side 46C of the guide member 40 and at least a fourth roller 44D attached a right side 46D of the guide member 40. Each of the first 44A, second 44B, third 44C and fourth 44D rollers may maintain direct rotational contact with the track 20 and thereby cause the guide member 40 to remain contiguously conjoined to the track 20 during displacement along an entire longitudinal length of the track 20. The number of rollers 44A-44D preferably being the only frictional contact with the track 20 allows the guide member 40 to traverse the track 20 with little physical effort by the user. This is advantageous in that it allows the user to perfect the movement of their swing without excessive frictional resistance being imparted by the contact maintaining mechanism 42

Referring now to FIGS. 4-9, as the curvilinear track may be suitably sized and shaped to simulate an ideal golf swing, proper user swing mechanics must first be achieved to obtain a resistance free swing. Therefore, the variable radius of the curvilinear track may provide the user with noticeable swing resistance "feedback" indicative of incorrect head, hand, arm, or body positional movements throughout all key swing positions. Once the user corrects the swing flaws, only the minimal frictional resistance of the mechanism 42 may be encountered. This user feedback system may be similar to the Medicus™ hinged club trainer which breaks down if the swing is flawed.

Referring again to FIGS. 1-9, the user teaching mechanism 30 may further include a mechanism 50 for prohibiting the user's head from rising beyond a predetermined height during the swinging procedures. This head prohibiting mechanism 50 may include an arm 52 statically anchored to the frame 22 and extended forward from the track 20, and a stop member 54 directly attached to an anterior tip 55 of the arm 52. The stop member 54 may be situated adjacent to a peak of the bi-directional path and may maintain continuous contact with the top of the user's head during the swinging procedures. This provides the unpredictable and unexpected benefit of training the user to maintain the correct position of their head during the swing. As a very common problem for most golfers occurs when the head is pulled back before the end of the swing, the head positioning mechanism 50 is vital and advantageous in situating the position of the user's head and entire body during the swing.

Additionally referring to FIGS. 1-9, the user teaching mechanism 30 further may include a mechanism 60 for indicating proper right arm movement of the user during an initial backswing along the bi-directional path. This proper right arm movement indicating mechanism 60 may include a curvilinear rod 62 preferably having opposing ends 63, 64 fixedly anchored to the frame 22 and configured in such a manner to interest a rearwardly rising motion during swinging procedures. This may thereby prevent the user from dropping the right elbow and bringing it too close to the body during the swing procedures. This mechanism 60 further teaches the appropriate movement of the user's body along the back swing as the user's back upper arm is encouraged to assume a position parallel to the ground, with the forearm at a right angle to the upper arm upon completion of the backswing, as opposed to dropping the back elbow toward the body and incorrectly adjusting the down swing.

The combination of the head positioning mechanism 50 with the proper arm movement mechanism 60 provides an unpredictable and unexpected result which is not rendered obvious by one skilled in the art. The elements of the present invention 10 simultaneously control the movement and position of the essential muscles of the user's body used during a desired golf swing to effectively train the user in a manner not obvious to those skilled in the art. By employing the apparatus 10, a user may learn the important mechanics of a desired golf swing, while exercising the muscles required in performing the swing.

Referring again to FIGS. 10 and 11, the guide member 40 included with the golf swing exercising and training apparatus 10 may include a body 70, a first bracket 72 rotatably connected to a top face of the body 70, and a second bracket 74 pivotally attached directly to the first bracket 72. Also, the guide member 40 may include a rectilinear shaft 76 statically anchored to the second bracket 74. This may operate in such a manner that the second bracket 74 may be freely articulated about a fulcrum pivot axis defined at a connection point of the first 72 and second 74 brackets respectively. The rectilinear shaft 76 operates to mimic the feel of a golf club as the user grips the shaft 76 and uses it to direct the guide member 40 through the movements of the swing. The pivoting of the shaft 76 about the brackets allows the user's wrists to naturally turn as the guide 40 slides along the track 20 at different angles in relation to the user's body.

Referring generally to FIGS. 1-9, the present invention may further include a method for teaching a user to improve a golf swing. Such a method may include the chronological steps of first providing a curvilinear track 20 suitably sized and shaped to simulate a golf swing. Second, the method may include providing and attaching a frame 22 to the track 20 by situating the frame 22 on a ground surface in such a manner that the track 20 may remain at a substantially stable inclined position representative of an ideal swing plane during swinging procedures. Finally, a third step may include teaching the user to maintain the user's spine at a desired angle while further maintaining the user's head and arms registered at respective desired positions during execution of the golf swing. The method assists the user to achieve a flawless swing by repeatedly performing the preferred motions and teaching the user's muscles to replicate the motions when actually swinging a golf club on the course.

In alternate embodiments, the apparatus 10 may be produced for either left handed or right handed users. The track 20 may be manufactured in sizes fit for users of all ages and different arm lengths. The frame 22 may be manufactured with a means to raise or lower the apparatus 10 to accommodate users of all ages and heights. Other embodiments may include mechanisms to change the incline of the frame 22 permitting swing planes conducive to different sized golf clubs (e.g., drivers versus 7 irons or pitching wedges) Other embodiments may include mechanisms to assist the user in positioning their legs during the swinging procedures, preferably including foot holds mounted to the frame 22. Such foot holds may be adjustably positioned by the user to reflect the desired stance and spatial distance between the user's feet. Additionally, one embodiment may include a cross bar mounted on the rear of the frame 22 and adjustable behind the user's knees to assist the user in bending their knees to the proper angle. Further embodiments may include methods of replacing the rectilinear shaft 76 with the user's preferred golf club, to better practice in real life conditions.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A golf swing exercising and training apparatus for assisting a user to improve a golf swing, said golf swing exercising and training apparatus comprising:

a curvilinear track suitably sized and shaped to simulate a golf swing;

a frame attached to said track and being situated on a ground surface such that said track remains at a substantially stable inclined position during swinging procedures; and means for teaching the user to maintain a user spine at a desired angle while further maintaining user head and arms registered at respective desired positions during execution of the golf swing;

wherein said guide member comprises a body;

a first bracket connected to a top face of said body;

a second bracket pivotally attached directly to said first bracket; and a rectilinear shaft statically anchored to said second bracket in such a manner that said second bracket is freely articulated about a fulcrum pivot axis defined at a connection point of said first and second brackets respectively.

2. The golf swing exercising and training apparatus of claim 1, wherein said user teaching means comprises:

a moveable guide member slidably coupled to said track and being freely displaced along a bi-directional path while executing the golf swing; and means for maintaining direct and continuous contact between said guide member and said track as said guide member is displaced along the bi-directional path such that said guide member is prohibited from oscillating away from the track.

3. The golf swing exercising and training apparatus of claim 2, wherein said direct and continuous contact maintaining means comprises:

at least a first roller attached to a top side of said guide member;

at least a second roller attached to a bottom side of said guide member;

at least a third roller attached to a left side of said guide member; and at least a fourth roller attached a right side of said guide member;

wherein each of said first, second, third and fourth roller maintain direct rotational contact with said track and thereby cause said guide member to remain contiguously conjoined to said track during displacement along an entire longitudinal length of said track.

4. The golf swing exercising and training apparatus of claim 1, wherein said user teaching means further comprises:

means for prohibiting the user head from rising beyond a predetermined height during the swinging procedures.

5. The golf swing exercising and training apparatus of claim 4, wherein said head prohibiting means comprises:

an arm statically anchored to said frame and extending forwardly of said track; and a stop member directly attached to an anterior tip of said arm;

wherein said stop member is situated adjacent to a peak of the bi-directional path and maintains continuous contact on top of the user head during the swinging procedures.

6. The golf swing exercising and training apparatus of claim 1, wherein said user teaching means further comprises:

means for indicating proper right arm movement of the user during an initial backswing along the bi-directional path.

7. The golf swing exercising and training apparatus of claim 6, wherein said proper right arm movement indicating means comprises:

a curvilinear rod having opposing ends fixedly anchored to said frame and configured in such a manner to interest a rearwardly rising motion during swinging procedures and thereby preventing the user from dropping the right elbow bringing it too close to the body during the swing procedures.

8. The golf swing exercising and training apparatus of claim 1, wherein said track is angularly offset from a vertical plane such that a beginning point of said track is situated anterior to a finishing point of said track.

9. A golf swing exercising and training apparatus for assisting a user to improve a golf swing, said golf swing exercising and training apparatus comprising:

a curvilinear track suitably sized and shaped to simulate an ideal golf swing and thereby provide swing resistance indicative of incorrect hand, arm, and body positional movements throughout a golf swing, said curvilinear track having minimal swing resistance when the hand, arm and body positional movements are correct throughout said golf swing;

a frame attached to said track and being situated on a ground surface such that said track remains at a substantially stable inclined position during swinging procedures; and means for teaching the user to maintain a user spine at a desired angle while further maintaining user head and arms registered at respective desired positions during execution of the golf swing;

wherein said guide member comprises a body;

a first bracket connected to a top face of said body;

a second bracket pivotally attached directly to said first bracket; and a rectilinear shaft statically anchored to said second bracket in such a manner that said second bracket is freely articulated about a fulcrum pivot axis defined at a connection point of said first and second brackets respectively.

10. The golf swing exercising and training apparatus of claim 9, wherein said user teaching means comprises:

a moveable guide member slidably coupled to said track and being freely displaced along a bi-directional path while executing the golf swing; and means for maintaining direct and continuous contact between said guide member and said track as said guide member is displaced along the bi-directional path such that said guide member is prohibited from oscillating away from the track.

11. The golf swing exercising and training apparatus of claim 10, wherein said direct and continuous contacting maintaining means comprises:

at least a first roller attached to a top side of said guide member;

at least a second roller attached to a bottom side of said guide member;

at least a third roller attached to a left side of said guide member; and at least a fourth roller attached a right side of said guide member;

wherein each of said first, second, third and fourth roller maintain direct rotational contact with said track and thereby cause said guide member to remain contiguously conjoined to said track during displacement along an entire longitudinal length of said track.

12. The golf swing exercising and training apparatus of claim 11, wherein said user teaching means further comprises:

means for prohibiting the user head from rising beyond a predetermined height during the swinging procedures.

13. The golf swing exercising and training apparatus of claim 12, wherein said head prohibiting means comprises:

an arm statically anchored to said frame and extending forwardly of said track; and a stop member directly attached to an anterior tip of said arm;

wherein said stop member is situated adjacent to a peak of the bi-directional path and maintains continuous contact on top of the user head during the swinging procedures.

14. The golf swing exercising and training apparatus of claim 11, wherein said user teaching means further comprises:

means for indicating proper right arm movement of the user during an initial backswing along the bi-directional path.

15. The golf swing exercising and training apparatus of claim 14, wherein said proper right arm movement indicating means comprises:

a curvilinear rod having opposing ends fixedly anchored to said frame and configured in such a manner to interest a rearwardly rising motion during swinging procedures and thereby preventing the user from dropping the right arm elbow and bringing it too close to the body during the swing procedures.

16. The golf swing exercising and training apparatus of claim 9, wherein said track is angularly offset from a vertical plane such that a beginning point of said track is situated anterior to a finishing point of said track and thereby encourage a full backswing with the user facing the target while fully pivoting on a right foot of the user with the user arms folded in toward a left shoulder of the user and said rectilinear shaft pointed down and behind a back of the user.

* * * * *

UNITED STATES PATENT AND TRADEMARK OFFICE

CERTIFICATE OF CORRECTION

PATENT NO. : 7,846,035 B2
APPLICATION NO. : 12/291716
DATED : December 7, 2010
INVENTOR(S) : William Bailey It is certified that error appears in the above-identified patent and that said Letters Patent is hereby corrected as shown below:

Column 4, lines 14-15, please replace the terms "statically anchored" with --rotatably connected--.

Column 7, lines 54-55, please replace the terms "statically anchored" with --rotatably connected--.

In claim 1, column 9, line 1, please replace the terms "statically anchored" with --rotatably connected--.

In claim 9, column 10, line 19, please replace the terms "statically anchored" with --rotatably connected--.

Signed and Sealed this
Eighth Day of February, 2011

David J. Kappos

David J. Kappos
*Director of the United States Patent and Trademark Office*